US005331797A

United States Patent [19]

Wurmli et al.

[11] Patent Number: 5,331,797

[45] Date of Patent: Jul. 26, 1994

[54] SPINNING RING FOR A RING SPINNING MACHINE

[75] Inventors: Arthur Wurmli, Winterthur; Herbert Stalder, Kollbrunn, both of Switzerland

[73] Assignee: Maschinenfabrik Rieter AG, Winterthur, Switzerland

[21] Appl. No.: 706,021

[22] Filed: May 28, 1991

[30] Foreign Application Priority Data

May 29, 1990 [CH] Switzerland ..... 01805/90-0

[51] Int. Cl.[5] ..... D01H 7/54

[52] U.S. Cl. ..... 57/119

[58] Field of Search ..... 57/119, 120, 121, 122, 57/125, 137

[56] References Cited

U.S. PATENT DOCUMENTS

| | | | |
|---|---|---|---|
| 504,997 | 9/1893 | Peirce | 57/119 |
| 598,200 | 2/1898 | Gilbert | 57/119 |
| 1,604,929 | 10/1926 | Merrill | 57/119 |
| 2,132,260 | 10/1938 | Fillinger | 57/122 |
| 2,132,261 | 10/1938 | Fillinger | 57/122 |
| 3,159,963 | 12/1964 | Zakharov | 57/119 |
| 3,323,300 | 6/1967 | Chilpan | 57/119 |
| 4,338,775 | 7/1982 | Würmli | 57/119 |

FOREIGN PATENT DOCUMENTS

| | | | |
|---|---|---|---|
| 1284338 | 11/1968 | Fed. Rep. of Germany | 57/119 |
| 2108225 | 8/1972 | Fed. Rep. of Germany | 57/119 |
| 1352920 | 1/1964 | France | 57/119 |
| 490532 | 6/1970 | Switzerland . | |
| 139581 | 8/1967 | U.S.S.R. | 57/119 |
| 1577151 | 10/1980 | United Kingdom . | |
| 8000982 | 5/1980 | World Int. Prop. O. . | |

*Primary Examiner*—Joseph J. Hail, III

*Attorney, Agent, or Firm*—Sandler, Greenblum & Bernstein

[57] ABSTRACT

A spinning ring of a ring spinning machine has an inclined flange which is configured such that a travel surface at the inner surface of the spinning ring has a radius (R2) which amounts to about 25 mm. and which merges into a radius (R1) which, at the location of the smallest inner diameter of the spinning ring, amounts to at least 1 mm. A rim or bead at the travel portion of the spinning ring has a height (H) which at most is about one-half larger than the thickness (K) of the rim. Consequently, there can be used travellers having small outer dimensions, so that there can be selected a larger wire thickness of the traveller material. In this way, the service life of the traveller in the ring spinning machine is increased in relation to the prior art. The radius (R1) which is large in comparison to prior art spinning rings and the comparatively small radius (R2) result in an approximately constant surface pressure between the traveller and the spinning ring and afford a stable travel of the traveller during ring spinning.

5 Claims, 2 Drawing Sheets

SPINNING RING FOR A RING SPINNING MACHINE

BACKGROUND OF THE INVENTION

1. Field of the Invention

The present invention broadly relates to textile machines, especially ring spinning machines and, in particular, is concerned with a new and improved spinning ring for a ring spinning machine and travellers used with such spinning ring.

Generally speaking, the spinning ring for a ring spinning machine constitutes a so-called inclined or oblique flange spinning ring. The inclined flange of the spinning ring is located between a base portion of the spinning ring bearing upon the spinning ring frame and the travel or running portion of the spinning ring. The traveller—sometimes also referred to in the art as a ring traveller—revolves or travels around the travel or running portion of the spinning ring. Furthermore, a rim or bead is provided at the travel portion of the spinning ring and which secures the position of the traveller. The dimensions of the base portion and the travel or running portion are chosen such that the spinning ring conically tapers from the base portion towards the travel or running portion, so that the inclined flange is similar to or approximates a circular truncated cone. Moreover, the height of the rim or bead in the meridian section of the spinning ring exceeds the thickness of the rim or bead by at most one-half, wherein the height of the rim or bead is measured substantially parallel to the generatrix of the circular truncated cone and the thickness is measured in a direction transverse thereto.

2. Discussion of the Background and Material Information

Inclined or oblique flange spinning rings are known to the art for quite some time, as evidenced by, for example, U.S. Pat. No. 3,159,963, granted Dec. 8, 1964, and entitled "RING FOR SPINNING AND TWISTING FRAMES AND TRAVELLER FOR THE SAME".

These inclined or oblique flange spinning rings are employed in order to increase the contact surface between the spinning ring and the traveller, and by virtue of a reduction of the specific surface pressure or compression there is also reduced the wear of the spinning rings and at the same time there is increased the movement stability of the traveller upon the spinning ring.

With known spinning rings containing an inclined or oblique flange, the inclination of this inclined or oblique flange, and thus the inner travel or running surface of the spinning ring, amounts to 38° or more with respect to the vertical. As will be explained in greater detail hereinafter, due to this pronounced inclination of the travel surface there prevails a relatively high load between the spinning ring and the traveller at the location of the smallest diameter of the spinning ring. This localized pronounced loading of the spinning ring reduces its service life too intensely, especially when there exist high spindle velocities.

A merely slight arching or doming of the travel or running surface of the spinning ring at the conical inner surface of the inclined flange can result in instability of the traveller, since such traveller is insufficiently urged into its stabile position with line contact at the travel or running surface of the spinning ring. This can likewise lead to increased wear of the traveller, and thus, also of the spinning ring. If the radius of the spinning ring is selected too small at the location of the smallest internal diameter thereof, then at this location the surface pressure between the spinning ring and the traveller is appreciably greater than at the remaining regions of the traveller. This likewise results in increased wear at the corresponding locations, so that there is further diminished the service life of the traveller at the ring spinning machine. This is the case for the heretofore known solutions.

Furthermore, spinning rings constructed according to the prior art possess the drawback that the height of the rim or bead at the travel or running portion of the spinning ring is chosen to be unnecessarily large. The height in the direction of the inclination of the flange can amount to more than twice the thickness of the rim or bead, resulting in an increase in the dimensions and the mass of the traveller. For a given wire diameter of the traveller, this leads to a comparatively large surface pressure of the traveller because of the centrifugal force. In the event there should be maintained a predetermined mass of the traveller, then the wire diameter of the traveller must be selected to be so small that the surface pressure between the traveller and the spinning ring, again because of the smaller contact surface, becomes so large that there arises impermissible wear.

In British Patent No. 1,577,151, published Oct. 22, 1980, and entitled "METHOD OF REFURBISHING A USED SPINNING RING AND A SPINNING RING REFURBISHED BY THE METHOD", there is disclosed an inclined flange spinning ring, wherein the inclination of the inclined flange only amounts to about 30° with respect to the vertical. Also the dimensions of the rim or bead all less unfavorable than is the case for other known inclined flange spinning rings, so that the height of the rim or bead amounts to only slightly more than its thickness as defined above. However, with this prior art spinning ring there still exists the drawback that the arching or curvature of the surface of the spinning ring at the location of the smallest diameter is relatively small in relation to the remaining dimensions, resulting in pronounced loading of this spinning ring at this location and at the corresponding contact zone of the traveller.

SUMMARY OF THE INVENTION

Therefore, with the foregoing in mind, it is a primary object of the present invention to provide an improved spinning ring for a ring spinning machine which is not afflicted with the aforementioned shortcomings and drawbacks of the prior art.

Another and more specific object of the present invention aims at the provision of an improved spinning ring for a ring spinning machine which possesses an exceptionally great service life and renders possible large spinning velocities, while eliminating the drawbacks of the prior art construction of spinning rings. With smaller wire diameter the wear reserve is, however, less if there is to be maintained a predetermined minimum wire cross-section.

Still a further noteworthy object of the present invention is the provision of an improved combination of spinning ring and traveller for use with such spinning ring, wherein there are achieved increased spinning velocities with lesser wear of the travellers and the spinning rings and an enhanced quality of the produced spun yarn and lesser yarn breakage.

Now in order to implement these and still further objects of the present invention, which will become more readily apparent as the description proceeds, the spinning ring for a ring spinning machine as contemplated by the present development is manifested, among other things, by the features that the thickness of the rim or bead amounts to between 2.0 mm. and 2.6 mm. and the height between 2.2 mm. and 2.8 mm, and the radius of a partial travel or running surface, at the smallest diameter of the spinning ring at the inner surface thereof, amounts to at least 1 mm.

Furthermore, the radius of a travel or running surface at the inner surface or at the inside of the travel or running portion of the spinning ring, measured in meridian section, amounts to at most 30 mm.

Moreover, this travel or running surface at the inner surface of the spinning ring, at the region of the radius thereof which amounts to at most 30 mm., possesses a mean or average inclination of at most 35° with respect to the vertical.

Also, the inner radius of the traveller, which is correlated with the radius of the partial travel or running surface at the smallest diameter of the spinning ring at the inner surface thereof, amounts to about 1.2-fold the value of such radius of the partial travel or running surface of the spinning ring.

When ring spinning machines are equipped with spinning rings constructed according to the present invention, there can be advantageously realized greater spinning velocities with concomitant reduced wear of the travellers and the spinning rings. By virtue of the enhanced performance of the traveller during its rotation or travel upon the associated spinning ring there is beneficially improved the quality of the spun yarn and there result fewer yarn breakages.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the ring spinning machine, and specifically the spinning ring with the associated traveller have been depicted therein, in order to simplify the illustration, as needed for those skilled in the art to readily understand the underlying principles and concepts of the present invention.

Figure 1:
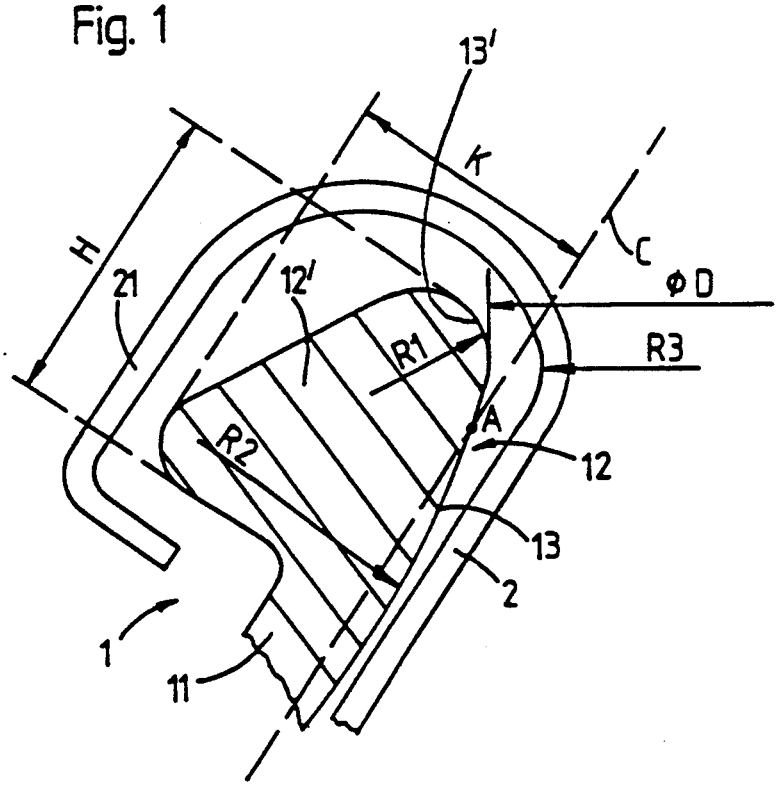
FIG. 1 illustrates in fragmentary view a portion of a meridian section through an inventive spinning ring of a ring spinning machine and equipped with a traveller.
Figure 2:
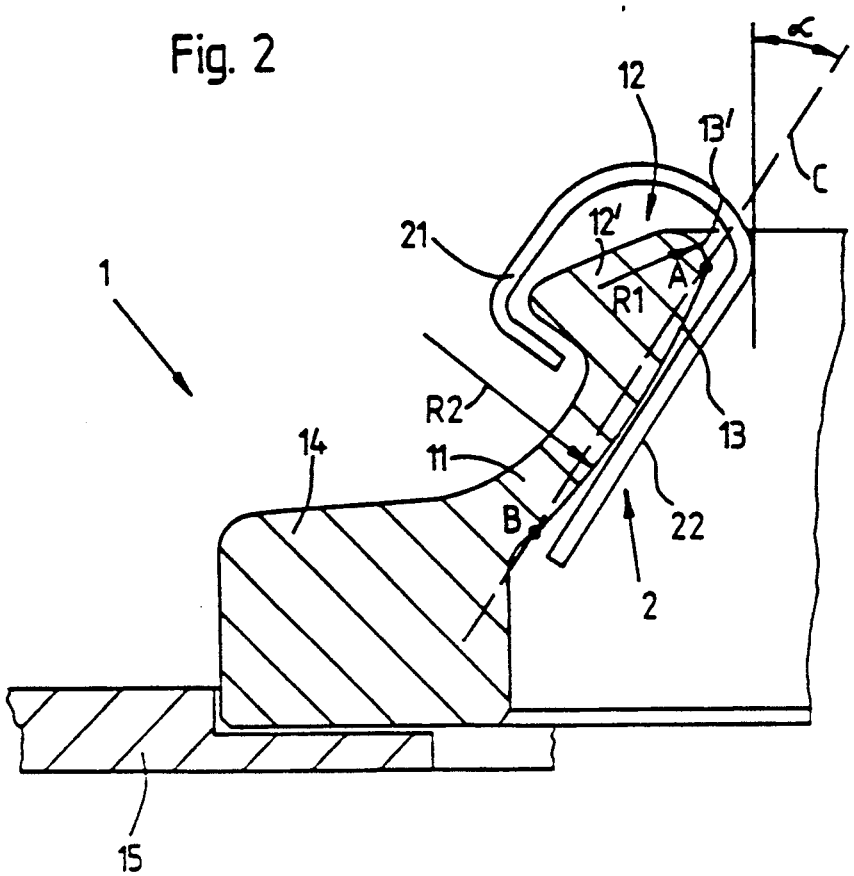
FIG. 2 is a fragmentary front view, again in meridian section, of the spinning ring equipped with the traveller.

Turning attention now to FIGS. 1 and 2, there has been shown a spinning ring 1, constructed according to the teachings of the present invention, which is mounted in a ring frame 15 of the ring spinning machine. The base portion 14 of the spinning ring 1 which is connected with the ring frame 15 extends upwardly at an inclination to form the so-called inclined or oblique flange 11. This inclined flange 11, in turn, merges into the travel or running portion 12 of the spinning ring 1. The inclined flange 11 is similar to or approximates a circular truncated cone having a generatrix which, according to the showing of FIG. 2, is inclined at an angle $\alpha$ with respect to the vertical. A rim or bead 12' is located at the top or upper region of the travel or running portion 12 of the spinning ring 1. This rim or bead 12', in addition to a travel or running surface 13, also guides a traveller 2 mounted upon the spinning ring 1.

Continuing, the travel or running surface 13 will be seen to possess a curvature between the points A and B, which can possess a constant or substantially constant radius of curvature R2. A partial travel or running surface 13' having a radius of curvature R1 merges with the travel portion 12 of the spinning ring 1 above the point A. The connection line C between the points A and B encloses with the vertical an angle $\alpha$ which preferably amounts to $33° \pm 2°$.

Figure 3:
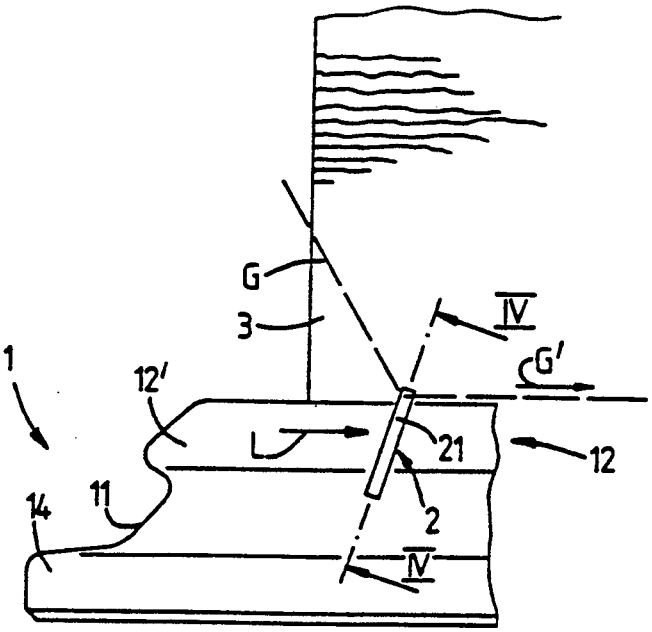
FIG. 3 is a fragmentary front view of the spinning ring equipped with the traveller during the revolving motion of the traveller in inclined position of such traveller.

In FIG. 2, the traveller 2 is shown in the meridian plane of the sectional illustration through the spinning ring 1 out of contact with such spinning ring 1. This traveller 2 essentially comprises an outer traveller leg 21 which engages about the rim or bead 12', and an inner traveller leg 22. The travel surface 13 of the spinning ring 1, formed as described above by parts of circular torus surfaces having the radii R1 and R2, in the ideal case would be formed by parts of hyperboloids with continuously altering radii in meridian section. However, in practice the approximation of a hyperboloid-part by a curved surface with constant radius is sufficient. The inner travel leg 22 of the traveller 2 can extend linearly between the points A and B. With the inclined position of the traveller 2 upon the spinning ring 1 during the rotation of such traveller 2 upon the spinning ring 1, as indicated in FIG. 3, the side of the traveller leg 22 which confronts the spinning ring 1, uniformly bears against the spinning ring 1 at the region between the points A and B, but also above the point A when the inner contour of the traveller leg 22 is appropriately configured at the point A.

If the radius R1 at the spinning ring 1 amounts to 1 mm., then there is selected for the corresponding inner radius R3 of the traveller 2, for instance, 1.2 mm. The configuration of the outer traveller leg 21 at the peripheral region of the rim or bead 12' is of lesser importance for the function of the traveller 2. Between the rim or bead 12' and the inner contour of the traveller leg 21 there must be sufficient space so as to preclude contact of the traveller 2, during its rotational movement upon the spinning ring 1, with the outer surface of the rim or bead 12'. Preferred dimensions of the spinning ring 1 in the meridian section amount to the following:

R1=<u>1.0</u> . . . 1.5 mm.,
R2=20 . . . <u>25</u> . . . 30.00 mm.,
$\alpha$=30° . . . <u>33</u> . . . 36°, H=2.0 . . . 2.5 . . . 3.0 mm., and
K=2.0 . . . 2.3 . . . 2.7 mm.

The above bold and underlined values are preferred for ring spinning machines in the yarn count range of 5 to 30 tex. The inner diameter D, according to FIG. 1, can thus amount to, for example, between 36 mm. and 40 mm.

FIG. 3 is a fragmentary front view of a spinning ring 1 equipped with the traveller 2 during the rotational movement of the traveller 2 upon the spinning ring 1 in the circumferential direction according to the direction indicated by the arrow L. The spun yarn G above the traveller 2 travels in the form of a thread balloon about the spindle 3, is deflected at the top of the traveller 2 and at that location travels in the direction of the arrow G' tangentially at the circumference of the spindle 3. As depicted in FIG. 3, the traveller 2, during its rotational movement or travel about the spinning ring 1, assumes an inclined or tilted position. This inclined position of the traveller 2 is dependent upon a number of factors, such as the spinning velocity, the yarn count, the spindle diameter, the yarn titer, the frictional conditions prevailing between the spinning ring 1 and the traveller 2 and so forth. With ideal conditions, the traveller 2 positions itself in relation to the spinning ring 1 such that its inner traveller leg 22 coincides at its inner surface with the generatrix of a hyperboloid which, as mentioned, is partially approximated by the travel or running surface 13 at the region between the points A and B by the curved surface having the radius of curvature R2 in the meridian section.

Figure 4:
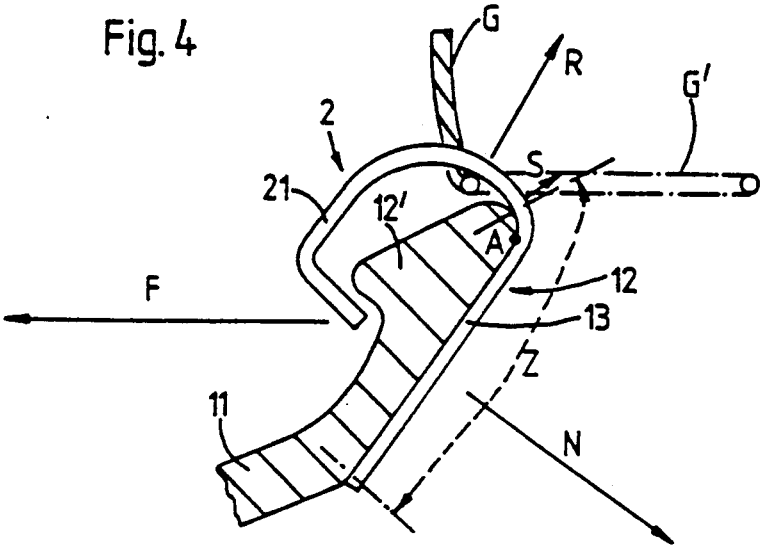
FIG. 4 is a fragmentary sectional view, taken substantially along the section line IV—IV of FIG. 3, of the spinning ring equipped with the traveller during the revolving motion of the traveller and depicting the forces acting upon such traveller.

FIG. 4 is a sectional view taken along the section line IV—IV through the spinning ring 1 of FIG. 3. In this FIG. 4 there have been depicted the forces which act upon the traveller 2, and specifically, the centrifugal force F owing to the mass of the traveller 2, the components of the resultant thread or yarn force R appearing in the sectional plane, the normal force N exerted by the spinning ring 1 upon the traveller 2, which is caused by the surface pressure between the traveller 2 and the spinning ring 1 beneath the point A, and the support force S which is transmitted at the partial travel or running surface 13' of the spinning ring 1 upon the corresponding portion of the traveller 2. The contact zone between the spinning ring 1 and the traveller 2 has been illustrated by the double headed broken arrow Z.

Figure 5:
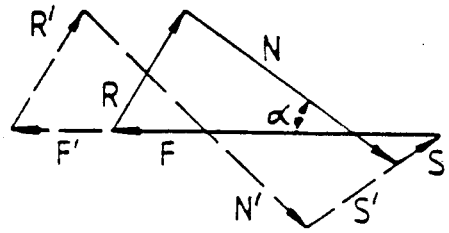
FIG. 5 is a force diagram depicting in solid lines the forces acting upon the traveller mounted upon a spinning ring constructed according to the invention and in broken lines there are depicted the forces acting upon a traveller mounted upon a spinning ring constructed in accordance with the prior art.

FIG. 5 is a force diagram which depicts the forces retaining the traveller 2 in equilibrium, and specifically, in solid lines portrays the conditions in a ring spinning machine according to the invention and in broken lines the conditions in a comparable ring spinning machine according to the prior art, as such has been disclosed, for example, in the aforementioned U.S. Pat. No. 3,159,963. The centrifugal force F' is appreciably greater than the centrifugal force F which is present with a spinning ring construction according to the present invention, since the outer traveller leg of the traveller of the prior art is appreciably longer than the outer leg 21 of the traveller 2 constructed according to the present invention. The components R and R' of the resultant thread or yarn force in the sectional plane are assumed to be of the same magnitude. The normal force N forms, together with the centrifugal force, according to a preferred embodiment, an angle $\alpha=33°$, whereas the corresponding angle, shown in broken lines in the force diagram of FIG. 5, is appreciably larger, for example, amounts to 38° in accordance with the inclination of the inner travel surface of the spinning ring of the aforementioned U.S. Pat. No. No. 3,159,963.

The value of the normal forces N and N', respectively, results from the assumption that the support forces S and S', respectively, for both cases under consideration extend at the same predetermined angle and close the respective force diagram at the origin of the centrifugal force F and F', respectively. It will be recognized upon comparing both of the force diagrams of FIG. 5, that, in particular, the support force S' of the prior art construction of spinning ring is appreciably greater than the support force S for an embodiment of spinning ring 1 constructed in accordance with the teachings of the present invention. As a result, there can be deduced that the wear, brought about by the support force S according to the present invention, at the partial travel surface 13' at the traveller 2 and at the spinning ring 1 for the design according to the present invention, will be appreciably smaller than the conventional combination of a spinning ring and traveller. This also explains the fact that with the embodiment of spinning ring constructed according to the present invention, there can be realized considerably greater spinning velocities with improved yarn quality and lesser wear at the spinning ring and the traveller.

While there are shown and described present preferred embodiments of the invention, it is distinctly to be understood the invention is not limited thereto, but may be otherwise variously embodied and practiced within the scope of the following claims.

What is claimed is:

1. A spinning ring for a ring spinning machine constituting an inclined flange spinning ring, comprising:

a base portion capable of bearing upon a spinning ring frame;

a travel portion about which revolves a traveller;

an inclined flange located between the base portion and the travel portion;

a rim having a height and a thickness provided at the travel portion for securing the position of the traveller;

the dimensions of the base portion and the travel portion being chosen such that the spinning ring substantially conically tapers from the base portion towards the travel portion, so that the inclined flange approximates a circular truncated cone;

the height of the rim in a meridian section of the spinning ring at most exceeds the thickness of the rim by one-half, wherein the height of the rim is measured substantially parallel to the generatrix of the circular truncated cone and the thickness is measured in a direction transverse thereto;

the thickness of the rim amounts to between 2.0 mm. and 2.6 mm. and the height between 2.2 mm. and 2.8 mm;

a partial travel surface provided for the travel portion and having a radius (R1); and the radius (R1) of the partial travel surface, measured at a smallest diameter of the spinning ring at an inner surface thereof, amounts to at least 1 mm.

2. The spinning ring as defined in claim 1, wherein:

the travel portion comprises a travel surface provided at an inner surface of the travel portion and having a radius (R2); and the radius (R2) of the travel surface, measured in the meridian section, amounts to at most 30 mm.

3. The spinning ring as defined in claim 1, wherein:

the travel portion includes a travel surface at an inner surface of the spinning ring; and the travel surface at the inner surface of the spinning ring possesses a mean inclination of at most 35° with respect to the vertical.

4. The spinning ring as defined in claim 1, in combination with a traveller having an inner radius (R3), wherein:

the inner radius (R3) of the traveller, which is correlated with the radius (R1) of the partial travel surface, amounts to about 1.2-fold the value of such radius (R1) of the partial travel surface of the spinning ring.

5. A spinning ring for a ring spinning machine constituting an inclined flange spinning ring, comprising:

a base portion capable of bearing upon a spinning ring frame;

a travel portion about which revolves a traveller;

an inclined flange interconnecting the base portion and the travel portion;

a rim having a height and a thickness provided at the travel portion for securing the position of the traveller;

the thickness of the rim amounts to between 2.0 mm. and 2.6 mm. and the height between 2.2 mm. and 2.8 mm;

a partial travel surface located adjacent the travel portion and having a radius (R1); and the radius (R1) of the partial travel surface, measured at a smallest diameter of the spinning ring at an inner surface thereof, amounts to at least 1 mm.

* * * * *